US009140123B2

(12) United States Patent
Meyer et al.

(10) Patent No.: US 9,140,123 B2
(45) Date of Patent: Sep. 22, 2015

(54) CUTTING HEAD TOOL FOR TUNNEL BORING MACHINE

(71) Applicant: Caterpillar Inc., Peoria, IL (US)

(72) Inventors: Robert Meyer, Metamora, IL (US); Gregory Tomlins, Peoria, IL (US); Glenn Mongillo, Markham (CA); Baldev Patel, Toronto (CA)

(73) Assignee: Caterpillar Inc., Peoria, IL (US)

( * ) Notice: Subject to any disclaimer, the term of this patent is extended or adjusted under 35 U.S.C. 154(b) by 108 days.

(21) Appl. No.: 13/850,014

(22) Filed: Mar. 25, 2013

(65) Prior Publication Data

US 2013/0264860 A1 Oct. 10, 2013

Related U.S. Application Data

(60) Provisional application No. 61/621,113, filed on Apr. 6, 2012.

(51) Int. Cl.

| | |
|---|---|
| ***E21C 35/183*** | (2006.01) |
| ***E21D 9/11*** | (2006.01) |
| ***E02F 9/28*** | (2006.01) |
| ***E21D 9/08*** | (2006.01) |
| ***E21B 10/43*** | (2006.01) |
| ***E21B 10/55*** | (2006.01) |
| ***E21B 10/567*** | (2006.01) |
| *E21C 35/193* | (2006.01) |
| *E21C 35/18* | (2006.01) |

(52) U.S. Cl.

CPC ..... *E21D 9/112* (2013.01); *E02F 9/2875* (2013.01); *E21B 10/43* (2013.01); *E21B 10/55* (2013.01); *E21B 10/567* (2013.01); *E21C 35/183* (2013.01); *E21D 9/081* (2013.01); *E21C 35/1936* (2013.01); *E21C 2035/1806* (2013.01); *E21C 2035/1809* (2013.01); *Y10T 29/49945* (2015.01)

(58) Field of Classification Search

CPC ..... E21C 2035/1809; E21C 2035/1806; E21C 35/1936

USPC ..... 299/55, 58, 62, 101, 111, 112 T, 113

See application file for complete search history.

(56) References Cited

U.S. PATENT DOCUMENTS

| | | | | | |
|---|---|---|---|---|---|
| 3,439,758 | A | * | 4/1969 | Petersen | 175/381 |
| 3,842,921 | A | * | 10/1974 | Dill et al. | 175/374 |
| 4,013,134 | A | | 3/1977 | Richmond et al. | |
| 4,108,692 | A | | 8/1978 | Quinlan | |
| 4,244,432 | A | | 1/1981 | Rowley et al. | |
| 4,679,640 | A | | 7/1987 | Crawford | |
| 4,944,559 | A | * | 7/1990 | Sionnet et al. | 299/105 |
| 5,131,481 | A | | 7/1992 | Smith | |
| 5,143,163 | A | * | 9/1992 | Stiffler et al. | 175/385 |
| 5,217,745 | A | | 6/1993 | Patel | |

(Continued)

*Primary Examiner* — David Bagnell
*Assistant Examiner* — Michael Goodwin
(74) *Attorney, Agent, or Firm* — Leydig, Voit & Mayer, Ltd.

(57) ABSTRACT

A ripper tool for a tunnel boring machine includes a tool body and a plurality of cutting element inserts. The tool body has a plurality of socket cavities. A tool body blank can be heat treated to increase the hardness of the tool body blank. The socket cavities can be machined in the tool body blank after the tool body blank is heat treated. The cutting element inserts are mounted to the tool body. The cutting element inserts are respectively press fit in the socket cavities. The ripper tool can be pivotably mounted to a cutter head of the TBM.

20 Claims, 19 Drawing Sheets

(56) References Cited

U.S. PATENT DOCUMENTS

| | | | | |
|---|---|---|---|---|
| 5,437,500 | A | 8/1995 | Lehmann et al. | |
| 5,586,057 | A | 12/1996 | Patel | |
| 5,647,448 | A | 7/1997 | Skaggs | |
| 5,900,077 | A | 5/1999 | McVicker et al. | |
| 6,339,868 | B1 | 1/2002 | Nagaya et al. | |
| 6,347,838 | B1 * | 2/2002 | Mukaidani et al. | 299/55 |
| 6,726,293 | B2 | 4/2004 | Anderton et al. | |
| 7,036,614 | B2 * | 5/2006 | Liang et al. | 175/374 |
| 7,260,468 | B2 | 8/2007 | Durand et al. | |
| 7,416,145 | B2 * | 8/2008 | Hall et al. | 241/197 |
| 7,462,222 | B2 | 12/2008 | Sellers et al. | |
| 7,513,108 | B2 | 4/2009 | Tomlins et al. | |
| 7,523,794 | B2 * | 4/2009 | Hall et al. | 175/374 |
| 7,712,692 | B2 * | 5/2010 | Hall et al. | 241/197 |
| 7,757,484 | B2 | 7/2010 | Bruza et al. | |
| 7,981,174 | B2 | 7/2011 | Bailey et al. | |
| 7,997,659 | B2 | 8/2011 | Oertley et al. | |
| 8,113,741 | B1 | 2/2012 | Vidovic et al. | |
| 2001/0015290 | A1 * | 8/2001 | Sue et al. | 175/374 |
| 2004/0168833 | A1 | 9/2004 | Narvestad | |
| 2005/0107021 | A1 | 5/2005 | Sjolander et al. | |
| 2005/0178587 | A1 | 8/2005 | Witman, IV et al. | |
| 2006/0087169 | A1 * | 4/2006 | Hesse et al. | 299/101 |
| 2008/0011519 | A1 | 1/2008 | Smith et al. | |
| 2008/0106138 | A1 * | 5/2008 | Yang | 299/104 |
| 2008/0207102 | A1 | 8/2008 | Sjolander et al. | |
| 2009/0079256 | A1 | 3/2009 | Oertley et al. | |
| 2009/0256413 | A1 * | 10/2009 | Majagi et al. | 299/100 |
| 2009/0294182 | A1 | 12/2009 | Hall et al. | |
| 2009/0322143 | A1 | 12/2009 | Krauter | |
| 2010/0025114 | A1 * | 2/2010 | Brady | 175/57 |
| 2010/0059286 | A1 | 3/2010 | McDonough et al. | |
| 2010/0141016 | A1 * | 6/2010 | Yang | 299/101 |
| 2010/0148566 | A1 | 6/2010 | Home et al. | |
| 2010/0159235 | A1 | 6/2010 | Johnston et al. | |
| 2011/0031017 | A1 | 2/2011 | Iwata et al. | |
| 2011/0209921 | A1 | 9/2011 | Barbera | |

* cited by examiner

CUTTING HEAD TOOL FOR TUNNEL BORING MACHINE

CROSS-REFERENCE TO RELATED APPLICATION

This patent application claims the benefit of priority to U.S. Provisional Patent Application No. 61/621,113, filed Apr. 6, 2012, and entitled "Cutting Head Tool for Tunnel Boring Machine," which is incorporated in its entirety herein by this reference.

TECHNICAL FIELD

This patent disclosure relates, generally, to a cutting head tool for a machine, and, more particularly, to a cutting head tool, such as a ripper tool, for a tunnel boring machine.

BACKGROUND

A tunnel boring machine (TBM) is designed for different geological conditions. Typically, a TBM is fitted with a number of cutting head tools, such as, ripper tools for softer rock conditions, for example. Ripper tools experience abrasive wear as well as impact loading. A ripper tool is considered a wear part that may be replaced repeatedly during the excavation of a given tunnel. It can be costly and time consuming to replace these ripper tools. As such, the industry highly values ripper tools possessing superior wear life.

A conventional ripper tool is manufactured by attaching carbide inserts to steel shanks through brazing. It has been observed that the brazing process softens the material of the shank, making it more susceptible to abrasive wear and other failures. In operation, this softened steel has a tendency to become "washed away" during cutting operations by abrasive action such that the shanks of the carbide inserts become exposed. The loss of the material allows the inserts to break off before the inserts themselves are completely worn, thereby necessitating the premature replacement of a ripper tool that otherwise still would have cutting life remaining.

U.S. Pat. No. 6,339,868 is entitled, "Cutting Tool and Shrink Fitting Method for the Same." The '868 patent is directed to a cutting tool including a tool holding portion and a tool. The tool is configured to be inserted into a hole of the tool holding portion. The tool includes a tool main body, a guide portion, and a shoulder portion. The tool main body has a tool outer diameter that is larger than the inner diameter of the hole when the tool holding portion is not heated. The guide portion is coaxially connected to the tool main body and configured to position the tool substantially coaxially with respect to the tool holding portion. The guide portion has a guide outer diameter that is smaller than the inner diameter of the hole so that the guide portion can be inserted into the hole. The shoulder portion is formed between the tool main body and the guide portion so as to sit on a surface around the hole to support the tool when the guide portion is inserted into the hole.

The '868 patent is also directed to a cutting tool shrink fitting method which includes inserting a guide portion which is coaxially connected to a tool main body of a tool into a hole formed in a tool holding portion in order to support and position the tool substantially coaxially with respect to the tool holding portion such that a shoulder portion which connects the tool main body and the guide portion sits on a surface around the hole of the tool holding portion. The tool holding portion is heated such that the tool main body of the tool can be inserted into the hole. The tool holding portion is cooled.

It will be appreciated that this background description has been created by the inventor to aid the reader, and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims, and not by the ability of any disclosed feature to solve any specific problem noted herein.

SUMMARY

The present disclosure is directed to providing a cutting head tool for a machine, such as a ripper tool for a tunnel boring machine. In an embodiment, a ripper tool for a tunnel boring machine includes a tool body and a plurality of cutting element inserts. The tool body has a plurality of socket cavities. The cutting element inserts are mounted to the tool body. The cutting element inserts are respectively press fit in the socket cavities.

In other embodiments, a machine includes a cylindrical shell and a cutter head rotatably mounted at a distal end of the cylindrical shell. The cutter head includes a ripper tool mounted thereto. The ripper tool has a tool body and a number of cutting element inserts. The tool body has a plurality of socket cavities. The cutting element inserts are mounted to the tool body. The cutting element inserts are respectively press fit in the socket cavities.

In other embodiments, a method for making a cutting head tool for a tunnel boring machine is described. A tool body blank is heat treated to increase the hardness of the tool body blank. A plurality of socket cavities are machined in the tool body blank in a predetermined hole pattern to form a tool body. A corresponding number of cutting element inserts are press fitted into the socket cavities in the tool body.

Further and alternative aspects and features of the disclosed principles will be appreciated from the following detailed description and the accompanying drawings. As will be appreciated, the ripper tools, machines, and methods for manufacturing cutting head tools disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Embodiments of a ripper tool, a machine, and a method for making a cutting head tool for a tunnel boring machine are described herein. In embodiments, a ripper tool for a tunnel boring machine includes a tool body and a plurality of cutting element inserts mounted to the tool body. The tool body has a plurality of socket cavities. Each cutting element insert is press fit in a respective socket cavity.

The tool body material can be a suitably hard and fracture-resistant steel, such as the steel described in U.S. Pat. No. 5,900,077 to McVicker et al. and entitled, "Hardness, Strength, and Fracture Toughness Steel," for example. The tool body can be subjected to a heat treating operation such that the hardness of the tool body is at least about 45 HRC, and in some embodiments between about 50 HRC and about 60 HRC. Counterbores can be machined in the tool body to define socket cavities. The counterbores for the cutting element inserts can be drilled and reamed to precise dimensions so that the interior dimension of each counterbore is within close tolerances. In embodiments, the socket cavities can be machined after the tool body blank has been heat treated.

The cutting element inserts can be press fitted into these bored holes with a slight interference fit. Each cutting element insert can be ground to tight tolerances so that its outside dimension is configured to assure a consistent press fit with the socket cavity into which it is pressed. To increase the wear life of the ripper tool, the assembly of the ripper tool can be accomplished without using a brazing operation, thereby avoiding the deleterious effects that can be caused by brazing, such as, softening the tool body.

Figure 1:
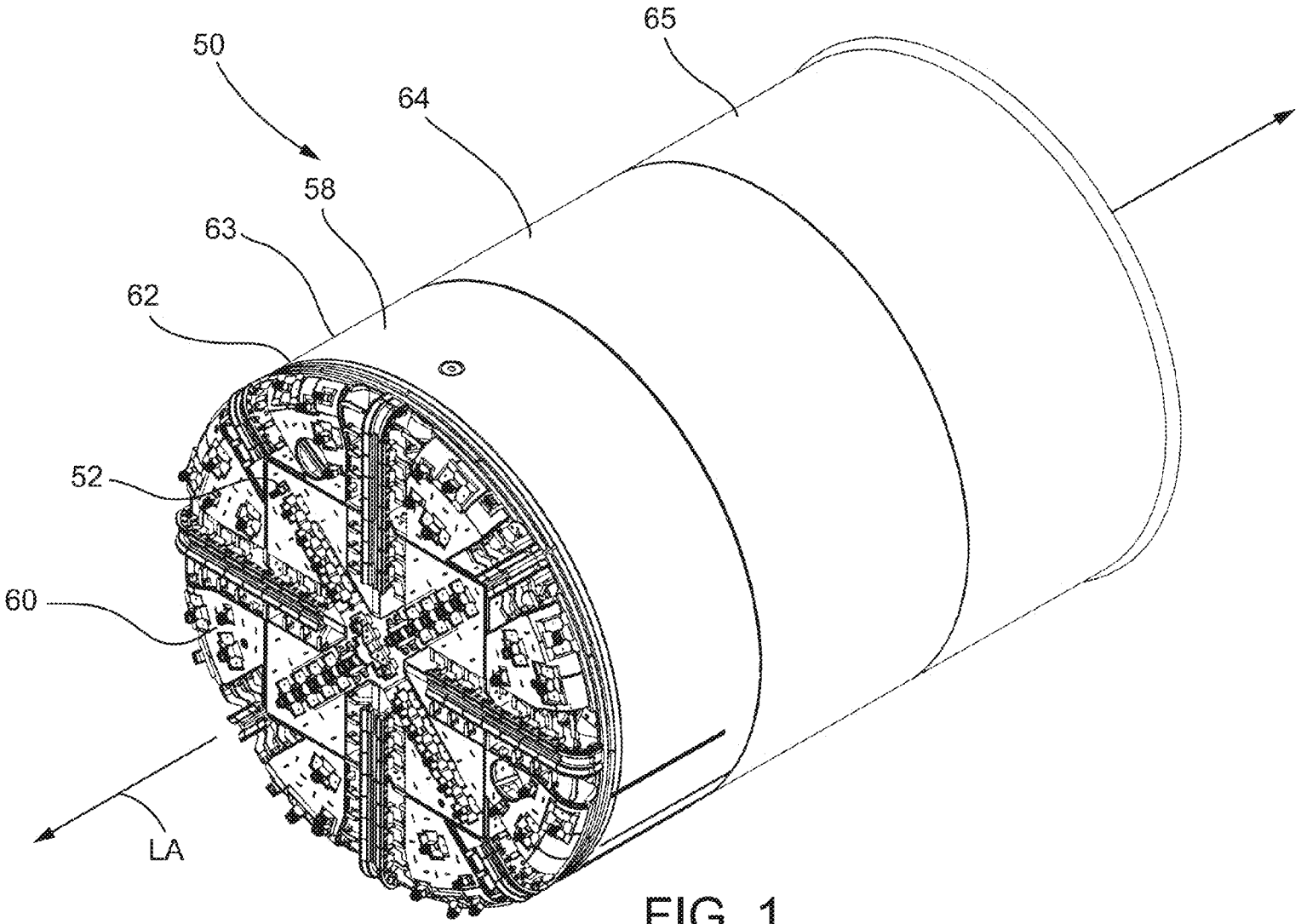
FIG. 1 is a perspective view of an embodiment of a machine having an embodiment of a ripper tool constructed in accordance with principles of the present disclosure.
Figure 2:
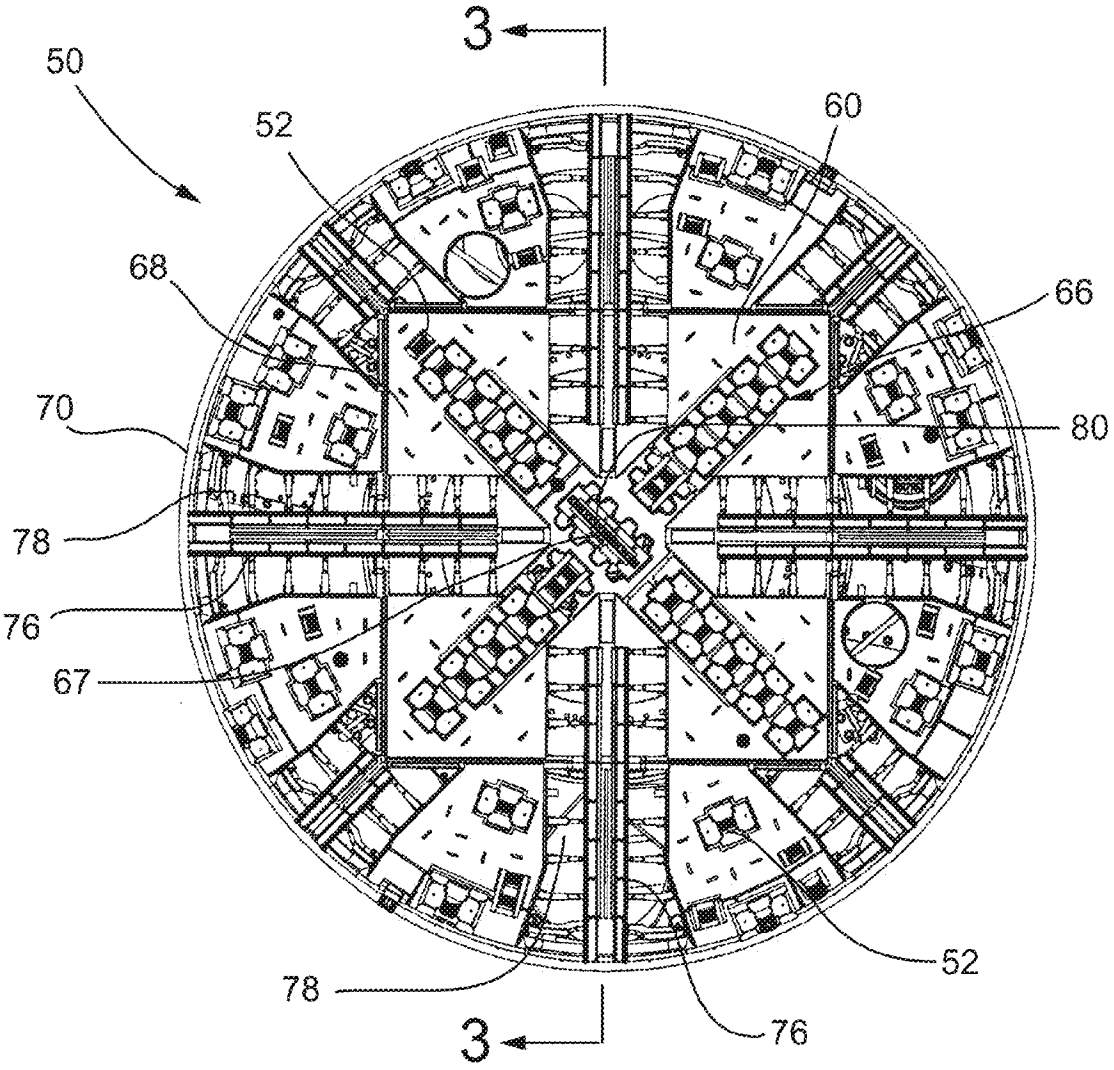
FIG. 2 is a cutter head end elevational view of the machine of FIG. 1.
Figure 3:
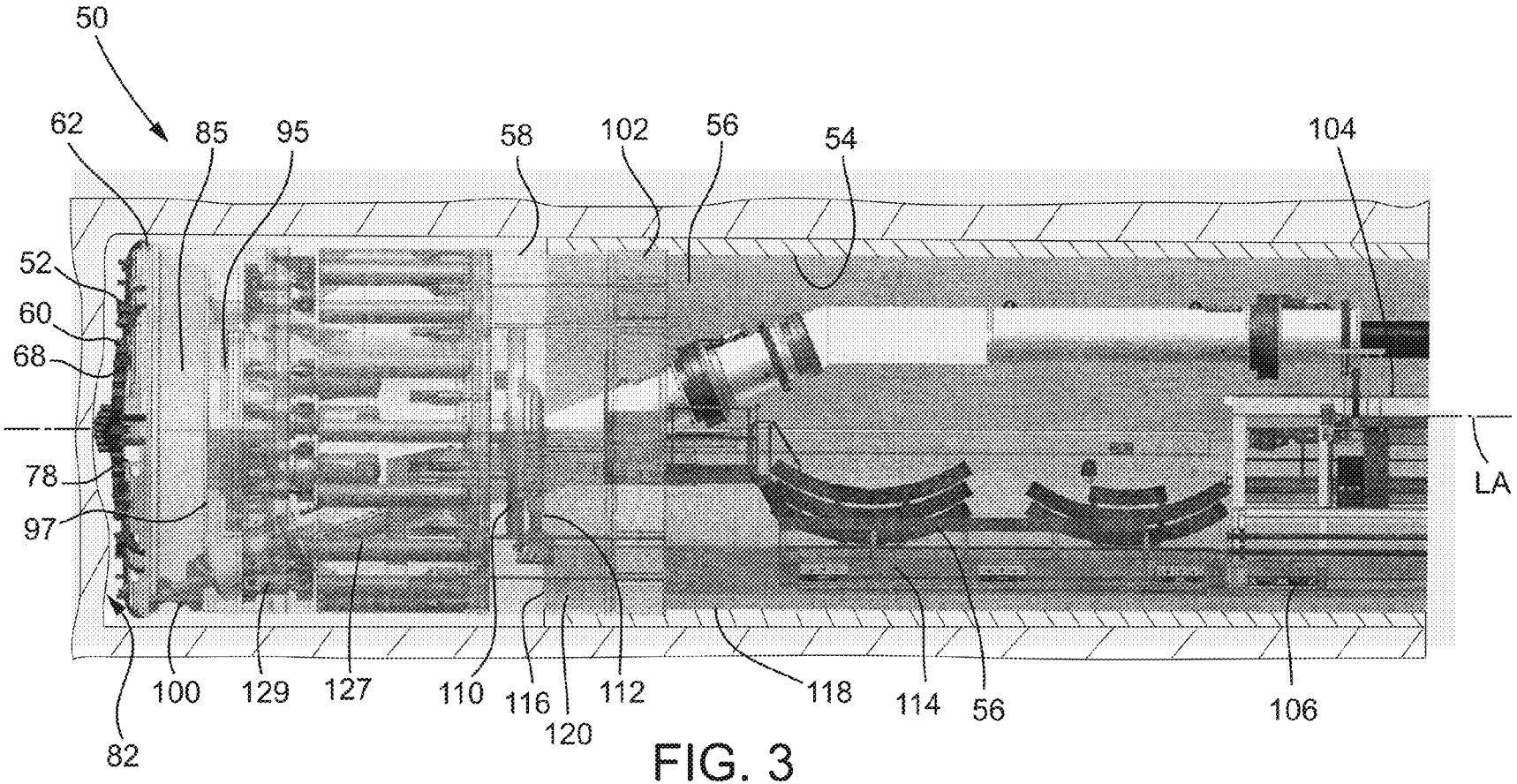
FIG. 3 is a longitudinal sectional view taken along line 3-3 in FIG. 2 of the machine of FIG. 1.

Referring now to the drawings, an exemplary embodiment of a machine in the form of a tunnel boring machine (TBM) 50 is illustrated in FIGS. 1-3. The TBM 50 includes an embodiment of a cutting head tool in the form of a ripper tool 52 constructed in accordance with principles of the present disclosure. It should be understood that, in other embodiments, many other types of machines can include a cutting head tool constructed in accordance with principles of the present disclosure. In still other embodiments, the TBM 50 can have a different configuration and can include other and different components.

The TBM 50 can be used to construct a tunnel 54 (FIG. 3), for example, through a variety of rock strata. The TBM 50 and its operating crew can perform several functions simultaneously to construct the tunnel 54, including boring the earth to form the tunnel 54, removing the tailings material excavated in the boring operation, lining the tunnel 54 with concrete tunnel lining segments 56 (FIG. 3), and installing utilities in the tunnel 54, such as fresh air conduits, power and water supply, etc.

Referring to the FIG. 1, the TBM 50 includes a cylindrical shell 58 and a cutter head 60 which is rotatably mounted at a distal end 62 of the cylindrical shell 58. The boring function of the TBM 50 is performed by the rotating cutter head 60 provided at the forward distal end 62 of the shell 58 of the TBM 50. The cutter head 60 is rotatable relative to the shell 58 around a longitudinal axis "LA" generally coaxial with the geometry of the tunnel 54.

The cylindrical shell 58 can include one or more shield segments 63, 64, 65 in the form of large metal cylinders. The cylindrical shell 58 can act a shield to support the tunnel 54 in areas within the TBM 50 which do not have the tunnel lining segments 56 in place yet.

Referring to FIG. 2, the illustrated cutter head 60 of the TBM 50 includes a plurality of cutters 66 extending radially from a center 67 of a face 68 of the cutter head 60 and extending around a perimeter 70 of the face 68. The illustrated cutters 66 of the cutter head 60 include a plurality of ripper tools 52 constructed according to principles of the present disclosure, which are pivotably mounted to the face 68 of the cutter head 60. The cutter head 60 also include a plurality of scrapers 76 disposed adjacent intake ports 78 and a centrally-located fish plate cutter 80. The intake ports 78 are configured to provide a suitable opening such that sand, gravel, rock fragments, and the like cut from an advancing tunnel face 82 (FIG. 3) by the cutter head 60 can be taken in and deposited in a mixing chamber 85 (FIG. 3) behind the face 68 of the cutter head 60.

In embodiments, the cutter head 60 can be a mixed face cutter head, which includes different types of cutters 66, including, for example, ripper tools, scrapers, spades, a fish plate cutter, and twin disc cutters rotatably mounted to the face 68, for example. In yet other embodiments, the cutter head 60 can have other configurations adapted for its intended purpose.

Referring FIG. 3, the cutter head 60 is rotatably provided at the forward distal end 62 of the cylindrical shell 58. The cutter head 60 is rotated by a drive system 95 provided in the cylindrical shell 58. The cutter head 60 rotates about the longitudinal axis "LA" to cut through and loosen the earthen material at the tunnel face 82 and move the freed material to the mixing chamber 85.

The rotating cutter head 60 gradually removes the material in the path of the TBM 50 at the tunnel face 82. As the tunnel face 82 is excavated and debris is removed, the length of the tunnel 54 increases. The TBM 50 is adapted to advance the cutter head 60 to maintain the engagement of the cutter head 60 with the tunnel face 82.

The mixing chamber 85 is formed between the face 68 of the cutter head 60 and a bulkhead 97 provided adjacent the distal end 62 of the cylindrical shell 58. The tailings excavated by the cutters 66 of the cutter head 60 are taken through the intake ports 78 into the mixing chamber 85. The tailings can be treated in the mixing chamber 85 with conditioners (such as foam, for example) formulated to create a slurry (sometimes referred to as "muck"). The mixing chamber 85 can be allowed to be filled with muck to maintain pressure at the face 68 of the cutter head 60 and allow the muck to act as a supporting medium.

A soil transportation screw conveyor 100 is provided to convey muck in the mixing chamber 85 to an aft portion 102 of the TBM 50. The screw conveyor 100 can be configured to deposit the muck on a belt conveyor 104 which conveys the muck to a railcar of a muck/supplies rail system 106 so that the rail car can be loaded with muck and sent out of the tunnel 54 to dispose of the muck. The muck/supplies rail system 106 can also be used to bring the tunnel lining segments 56 and other supplies into the tunnel 54 during its construction.

A movable segment erector 110 can be provided to selectively assemble the tunnel lining segments 56 in place to line the tunnel 54. The segment erector 110 is reciprocally movable along the longitudinal axis "LA" of the TBM 50 to allow an erector arm 112 of the segment erector 110 to grab one of the tunnel lining segments 56 from off of a segment car 114 and place it at a distal end 116 of a tunnel lining 118.

The erector arm 112 is rotatable about an axis parallel to the longitudinal axis "LA" to allow the erector arm 112 to place the tunnel lining segment 56 in a selected radial position so that the tunnel lining segments 56 can be circumferentially placed around the tunnel 54 in a lining ring segment 120 to completely line the tunnel 54. Once the forwardmost lining ring segment 120 is completed, the TBM 50 can be advanced along the longitudinal axis "LA" to allow the cutter head 60 to continue excavating to advance the length of the tunnel 54 and to allow the segment erector 110 to assemble another lining ring segment 120.

The cutter head 60 advances, and the cutters 66 are pushed against the tunnel face 82 typically under power from a hydraulic cylinder system 125. The hydraulic cylinder system 125 can be deployed along with brace members which push radially outward against the sides of the tunnel 54 in order to direct the force of the cutters 66 against the tunnel face 82. The hydraulic cylinder system 125 can include thrust cylinders 127 provided to continually advance the cutter head 60 relative to the cylindrical shell 58 of the TBM 50 which can be held in place relative to the tunnel 54 by brace members which radially engage the tunnel 54. The hydraulic cylinder system 125 can include articulation cylinders 129 provided to selectively articulate the cutter head 60 relative to the longitudinal axis "LA" of the TBM 50 to allow the TBM 50 to bore a tunnel with a curve in it.

Referring to FIGS. 4-7, an embodiment of a ripper tool assembly 135 constructed in accordance with principles of the present disclosure is shown. The ripper tool assembly 135 can include a ripper tool 52 pivotably mounted to a ripper housing 140. In other embodiments, the ripper tool assembly 135 can include a ripper tool 52 pivotably mounted to an adaptor box. The ripper tool assembly 135 can be mounted to the face 68 of the cutter head 60 such that the ripper tool 52 is positioned to engage the tunnel face 82 in front of the rotating cutter head 60.

Figure 4:
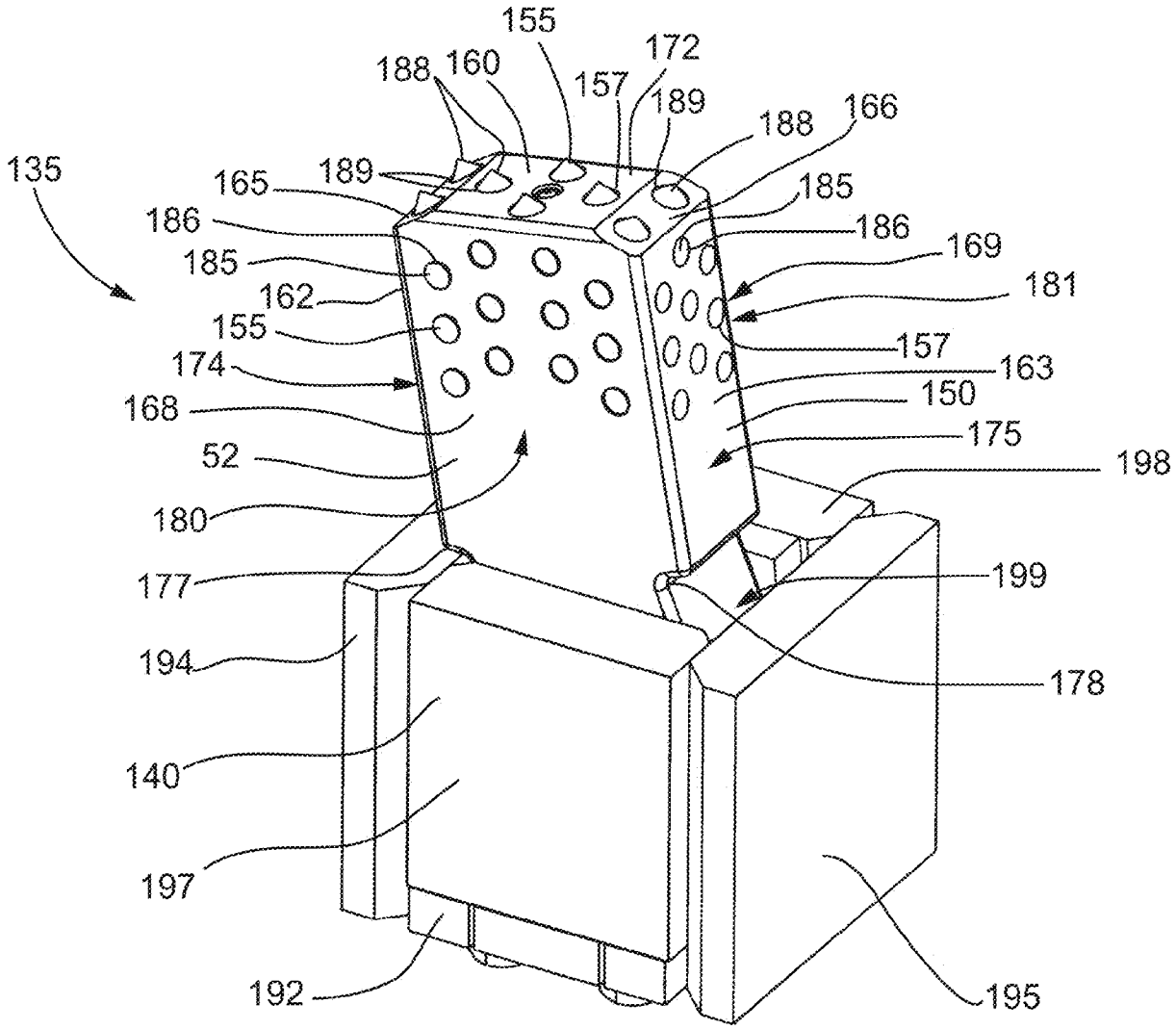
FIG. 4 is a perspective view of an embodiment of a ripper tool assembly constructed in accordance with principles of the present disclosure suitable for use in the machine of FIG. 1.

Referring to FIG. 4, the ripper tool 52 for the TBM 50 includes a tool body 150 and a number of cutting element inserts 155. The tool body 150 has a plurality of socket cavities 157. The cutting element inserts 155 are mounted to the tool body 150. The cutting element inserts 155 are respectively press fit in the socket cavities 157 of the tool body 150.

Figure 5:
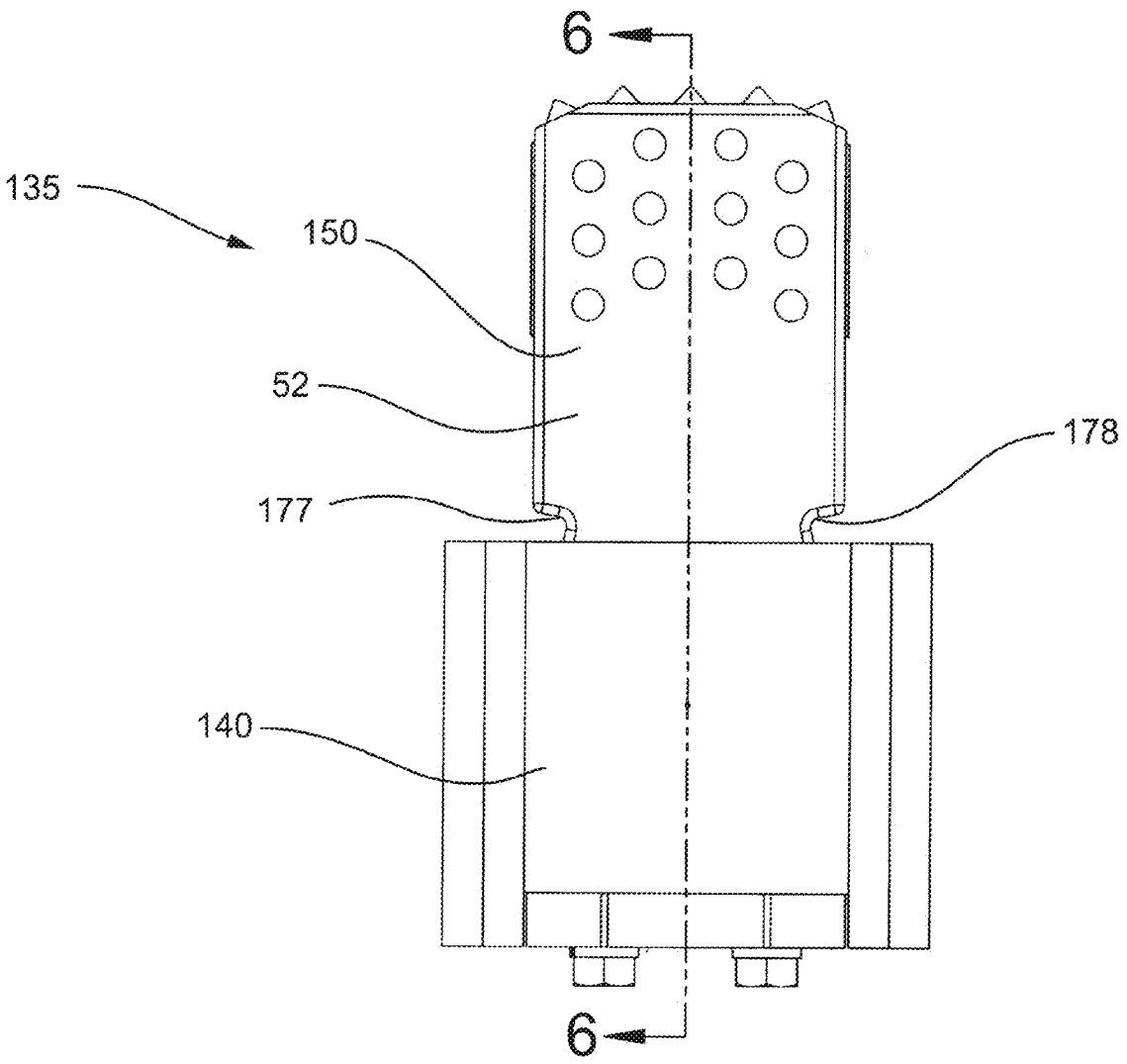
FIG. 5 is a washout face elevational view of the ripper tool assembly of FIG. 4.

Referring to FIGS. 4 and 5, the tool body 150 includes a penetrating end surface 160, a pair of ripping side surfaces 162, 163, a pair of chamfer surfaces 165, 166, and a pair of washout face surfaces 168, 169. The penetrating end surface 160 is disposed at a distal end 172 of the tool body 150. The ripping side surfaces 162, 163 are in spaced relationship to each other and disposed at a respective side 174, 175 of the tool body 150. The chamfer surfaces 165, 166 are disposed between the penetrating end surface 160 and the ripping side surfaces 162, 163, respectively. The sides 174, 175 of the tool body 150 each includes a shoulder 177, 178. The washout face surfaces 168, 169 are in spaced relationship to each other and respectively disposed at a front face 180 and a rear face 181 of the tool body. The washout face surfaces 168, 169 extend between the ripping side surfaces 162, 163.

In the illustrated tool body 150, the rear face 181 is substantially identical to the front face 180. The sides 174, 175 of the tool body 150 are also substantially the same. In other embodiments, the sides 174, 175 can be different from each other. In other embodiments, the front face 180 and the rear face 181 can be different from each other.

At least one of the cutting element inserts 155 can comprise a first cutter type 185 which is disposed in a first socket type 186 of the socket cavities 157. At least one of the cutting element inserts 155 can comprise a second cutter type 188 which is disposed in a second socket type 189 of the socket cavities 157. At least one of the socket cavities 157 of the first socket type 186 can be defined in at least one of the ripping side surfaces 162, 163 and have the first cutter type 185 press fit therein. At least one of the socket cavities 157 of the first socket type 186 can be defined in at least one of the washout face surfaces 168, 169 and have the first cutter type 185 press fit therein. At least one of the socket cavities 157 of the second socket type 189 can be defined in the penetrating end surface 160 and have the second cutter type 188 of the cutting element inserts 155 press fit therein (see FIG. 6 also). At least one of the socket cavities 157 of the second socket type 189 can be defined in at least one of the chamfer surfaces 165, 166 and have the second cutter type 188 press fit therein.

In the illustrated embodiment, the socket cavities 157 of the first socket type 186 are disposed in both ripping side surfaces 162, 163 and both washout face surfaces 168, 169 and are configured to receive the first cutter type 185 of the cutting element inserts 155. The socket cavities 157 of the second socket type 189 are disposed in both chamfer surfaces 165, 166 and are configured to receive the second cutter type 188 of the cutting element inserts 155. The socket cavities 157 of the second socket type 189 are disposed on the penetrating end surface 160 and are configured to receive the second cutter type 188 of the cutting element inserts 155.

The ripper housing 140 includes a base plate 192, a pair of side plates 194, 195, a front plate 197, and a rear plate 198 which define a cavity 199 therein adapted to receive the ripper tool 52. The ripper housing 140 can be adapted to be secured to the face 68 of the cutter head 60 such that the ripper tool 52 projects from the face 68 and is pivotable with respect to it.

The shoulders 177, 178 of the tool body 150 are adapted to engage the side plates 194, 195, respectively, to limit the range of travel over which the tool body 150 is rotatable.

Referring to FIG. 5, the ripper tool 52 is shown in a neutral position with respect to the ripper housing 140. In the neutral position, the shoulders 177, 178 of the tool body 150 are disengaged from the side plates 194, 195, respectively, of the ripper housing 140.

Figure 6:
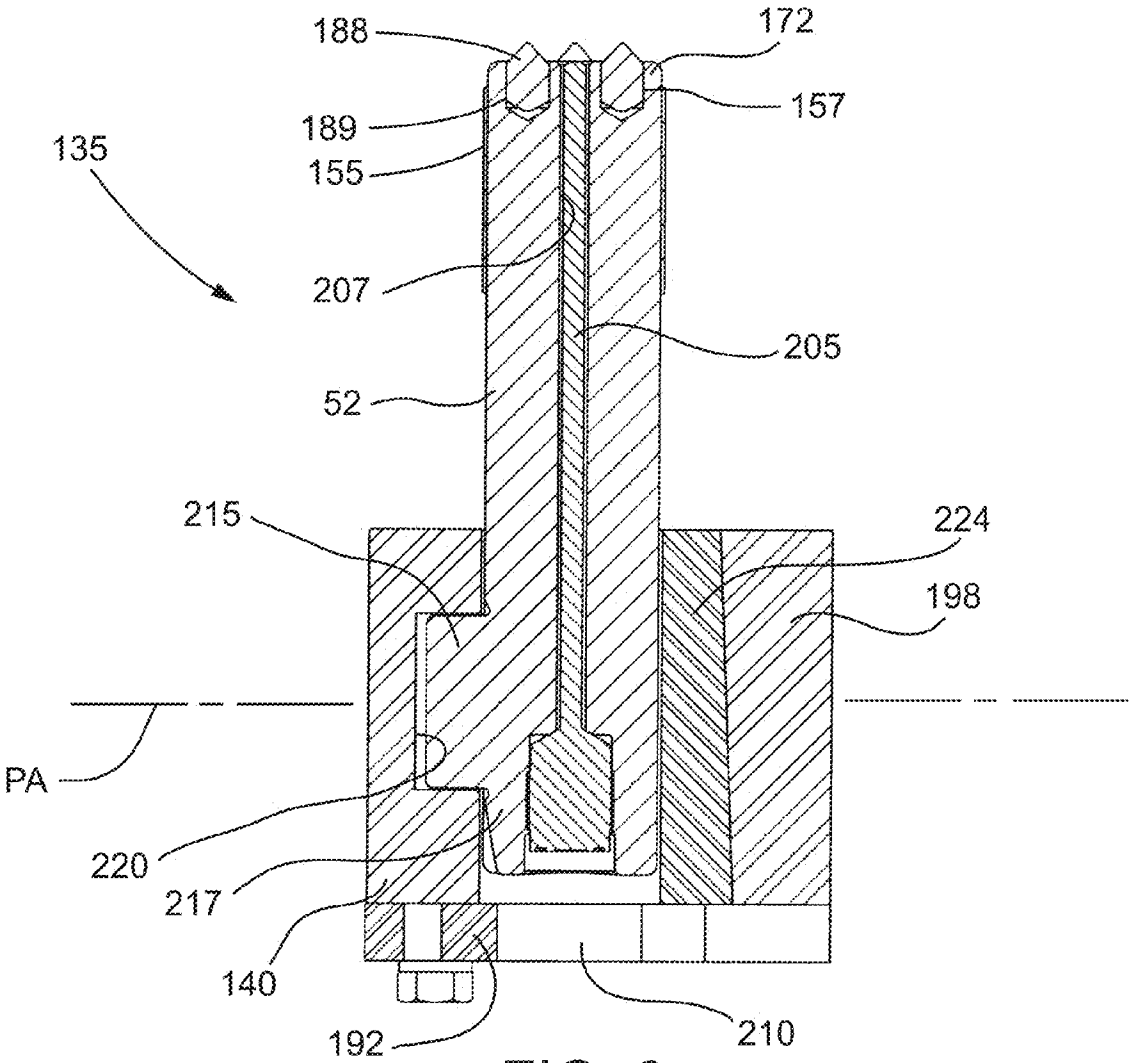
FIG. 6 is a cross-sectional view of the ripper tool assembly of FIG. 4 taken along line 6-6 in FIG. 5.

Referring to FIG. 6, a sensor device 205 can be disposed within a through bore 207 in the tool body 150. The sensor device 205 can be adapted to provide an electrical signal to a controller having a visual display device adapted to indicate to an operator of the TBM 50 the amount of expected life remaining in the particular ripper tool 52 and to signal the operator when the sensor device 205 detects that the ripper tool 52 should be replaced based upon its operation life and/or wear, for example. The base plate 192 can include an opening 210 therethrough to facilitate the operable connection of the sensor device 205 to the control module.

Figure 7:
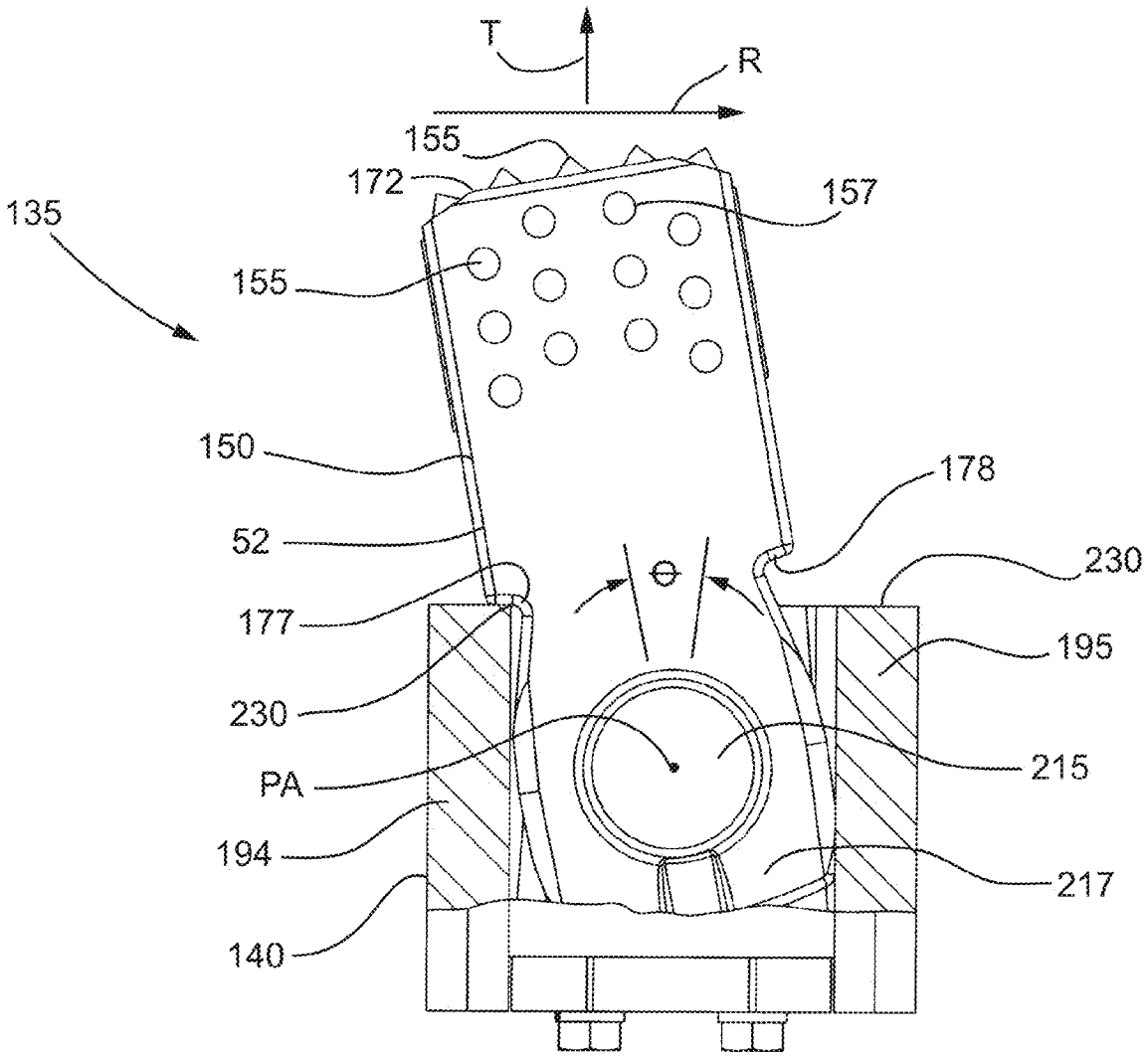
FIG. 7 is a view as in FIG. 5, of the ripper tool assembly of FIG. 4, but with a plate of a housing removed to illustrate the ripper tool rotated from a neutral position as in FIG. 5 to an engaged position.

Referring to FIGS. 6 and 7, the tool body 150 includes an integral pivot boss 215. The pivot boss 215 is disposed adjacent a proximal end 217 of the tool body 150, which is in opposing relationship to the distal end 172 thereof. The pivot boss 215 is configured such that it is pivotably retained by the ripper housing 140 with the cutting element inserts 155 of the ripper tool 52 projecting from the ripper housing 140.

Referring to FIG. 6, the front plate 197 of the ripper housing 140 includes a pivot bearing 220 adapted to support the pivot boss 215 of the tool body 150 such that the tool body 150 is rotatable about a pivot axis "PA" defined by the pivot boss 215 over a predetermined range of travel. The pivot bearing 220 is shaped to substantially conform the shape of the pivot boss 215 while allowing the pivot boss 215 to rotate relative to the pivot bearing 220. The ripper housing 140 can also include a back up plate 224 disposed within the cavity 199 between the tool body 150 and the rear plate 198. The back up plate 224 can be provided to help retain the pivot boss 215 in engaging relationship with the pivot bearing 220 such that the ripper tool is rotatably coupled to the ripper housing 140

Referring to FIG. 7, the pivotable connection between the tool body 150 of the ripper tool 52 and the ripper housing 140 allows the ripper tool 52 to rock back and forth in a bi-directional manner. The tool body 150 can rotate over a range of travel defined by a pivot angle "θ" about the pivot axis "PA" defined by the pivot boss 215. The pivot angle "θ" can be varied in embodiments to fit the cutting requirements of the intended application. In the illustrated embodiment, the pivot angle "θ" is about twenty degrees.

The TBM 50 excavating process involves driving the cutter head 60 so that the ripper tool 52 engages the tunnel face 82 with a thrusting force "T" in a direction substantially perpendicular to the tunnel face 82 and exerts a rotational force "R" parallel to the tunnel face 82 to shear the tunnel face 82 and as it rotates about the longitudinal axis "LA" over a circumference defined by the radial distance separating the ripper tool from the center 67 of the cutter head 60. Cutting head torque causes the cutting element inserts 155 of the ripper tool 52 to be pulled through the ground to excavate material. The ripper tool 52 can pivot about the pivot axis "PA" defined by the pivot boss 215 in a direction opposing the direction of rotation "R" of the cutter head 60 until the shoulder 177 of the tool body 150 engages the adjacent side plate 194 of the ripper housing 140. Each shoulder 177, 178 can be configured to engage a top edge 230 of the respective adjacent side plate 194, 195 of the ripper housing 140 to place the tool body 150 in engagement with the ripper housing 140. The engagement of the ripper tool 52 with the tunnel face 82 can load the cutting element inserts 155 in compression, which can help the cutting element inserts 155 remain seated in the respective socket cavities 157.

Figure 8:
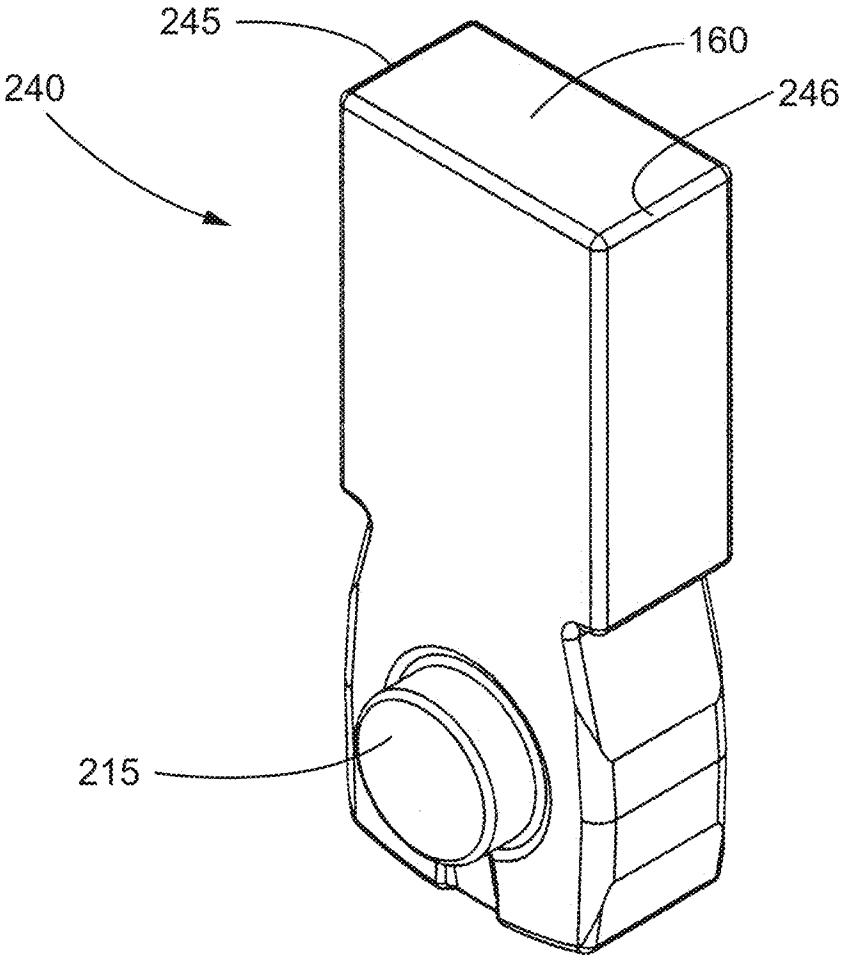
FIG. 8 is a perspective view of an embodiment of a tool body blank suitable for use in a ripper tool constructed in accordance with principles of the present disclosure.
Figure 9:
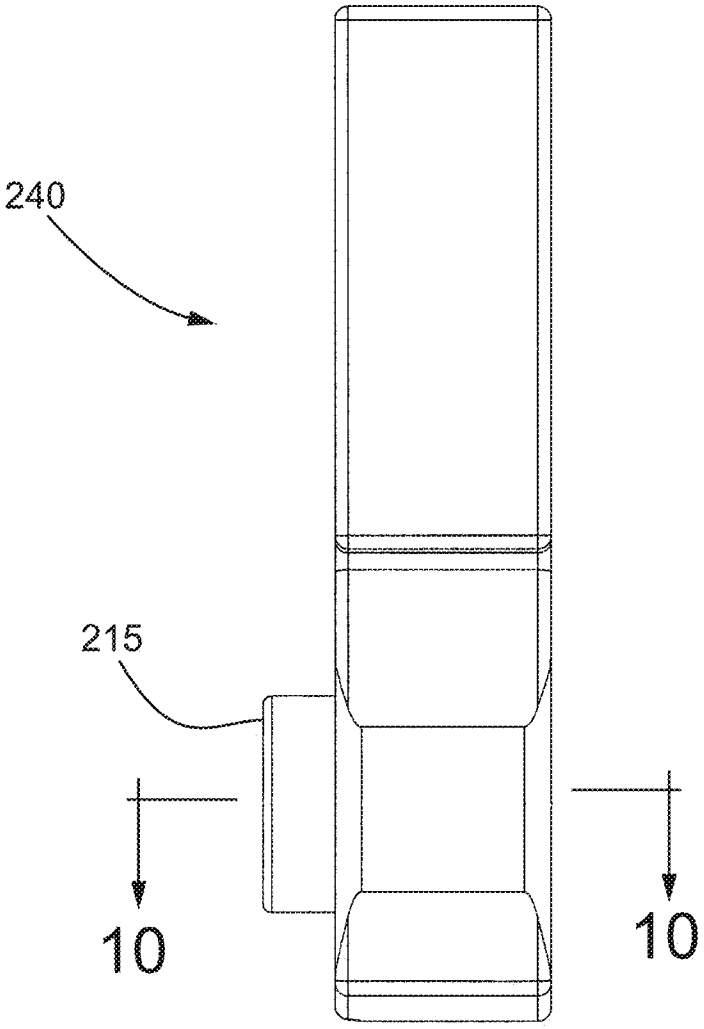
FIG. 9 is a ripping side elevational view of the tool body blank of FIG. 8.
Figure 10:
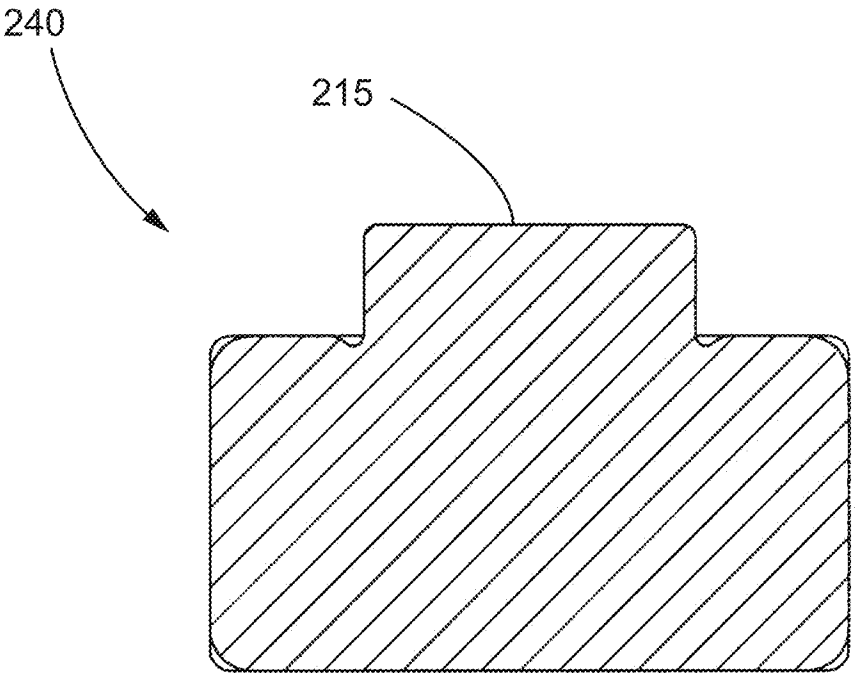
FIG. 10 is a cross-sectional view of the tool body blank of FIG. 8 taken along line 10-10 in FIG. 9.
Figure 11:
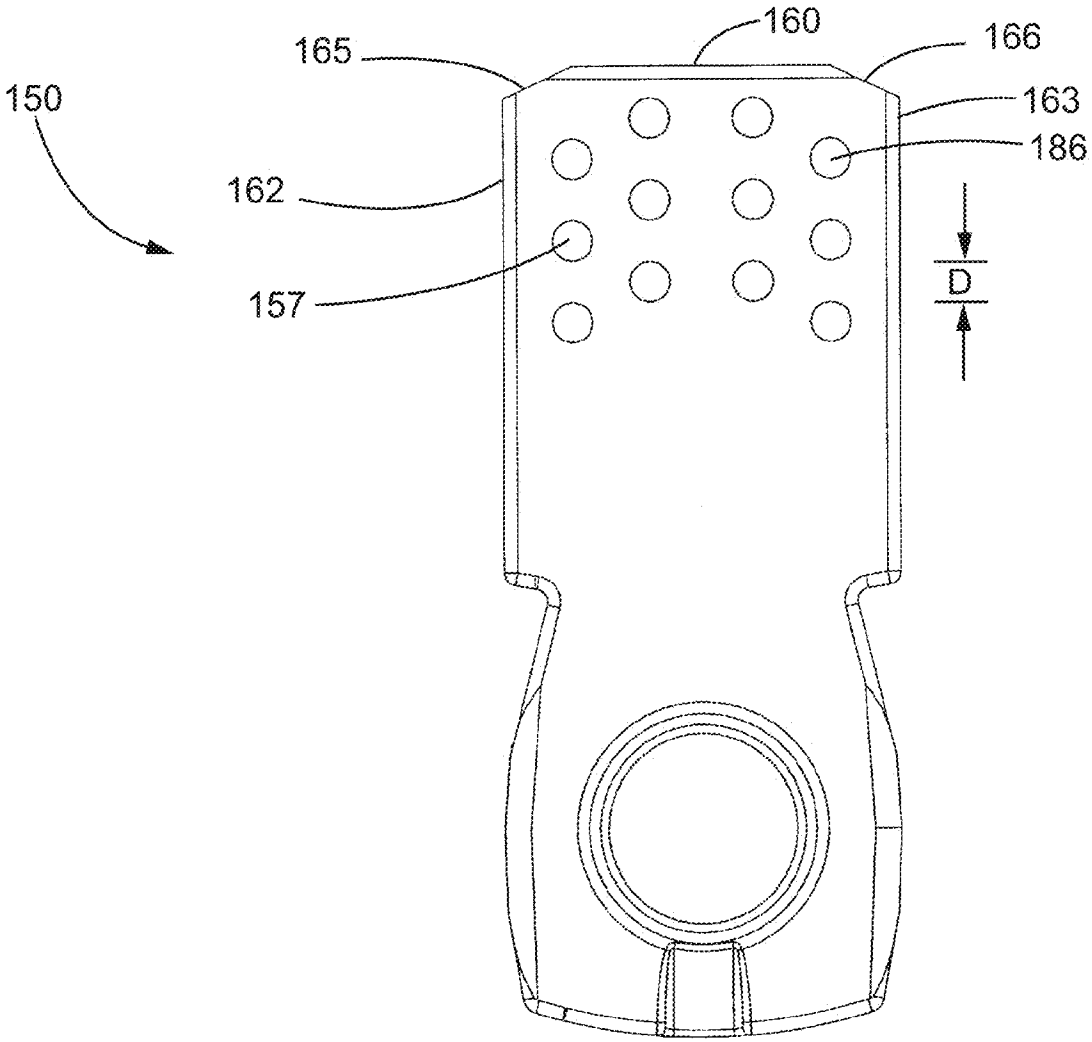
FIG. 11 is a washout face elevational view of an embodiment of a tool body suitable for use in a ripper tool constructed in accordance with principles of the present disclosure, the tool body made from the tool body blank of FIG. 8.
Figure 12:
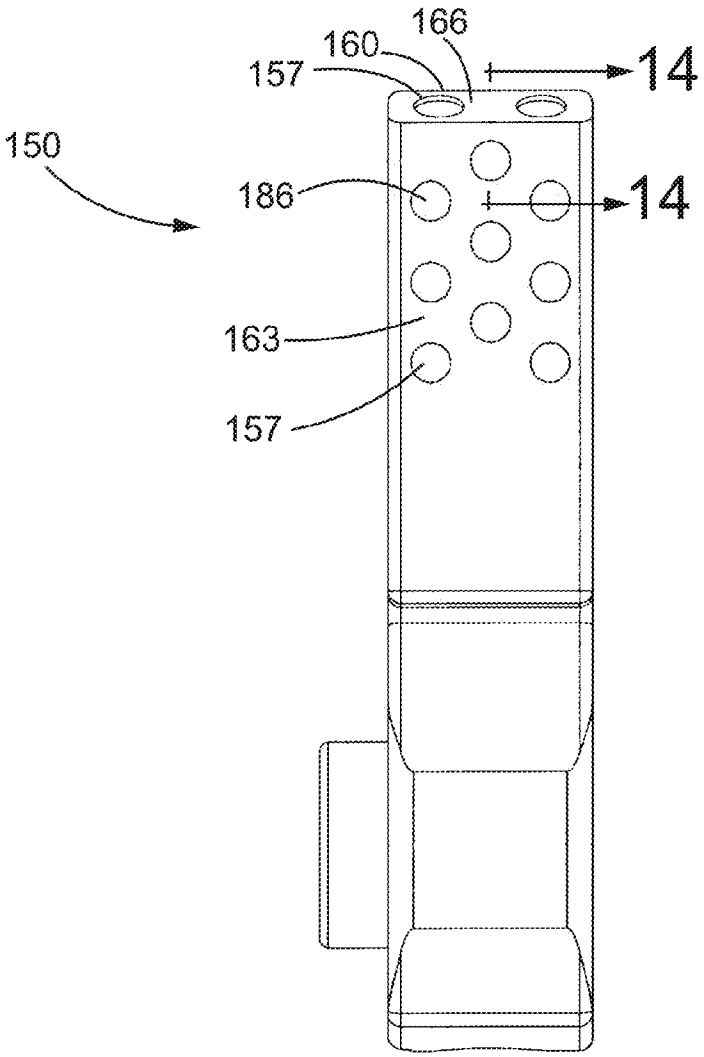
FIG. 12 is a ripping side elevational view of the tool body of FIG. 11.
Figure 13:
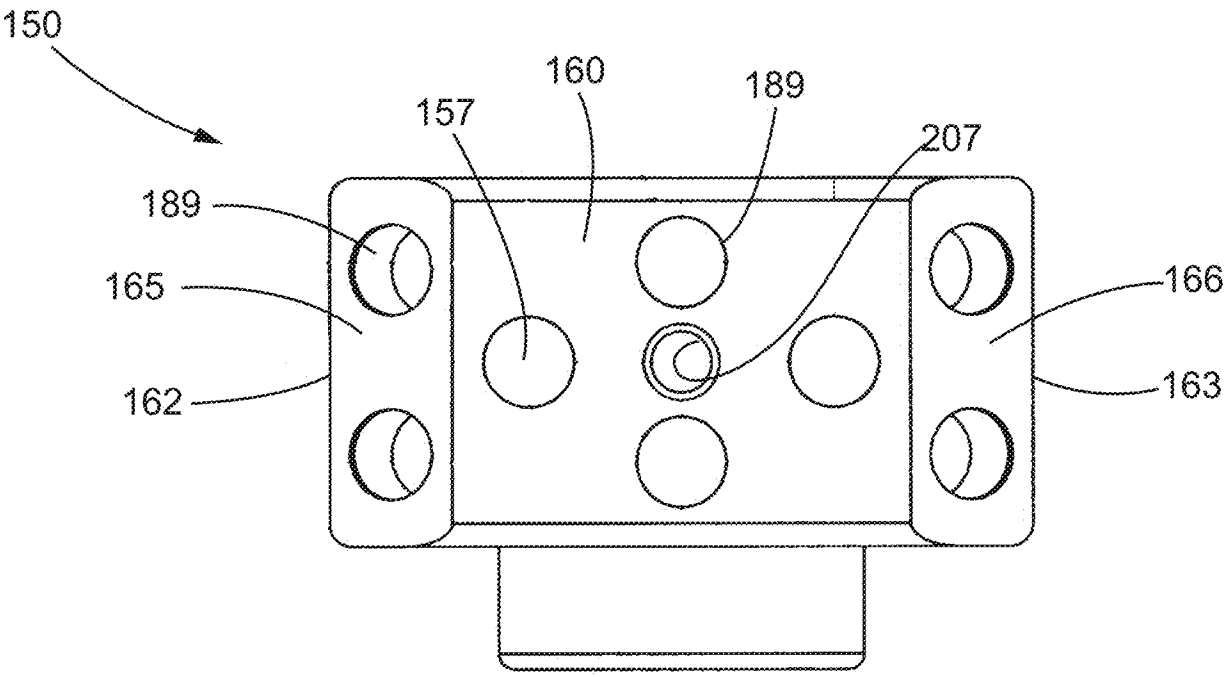
FIG. 13 is a top plan view of the tool body of FIG. 11.
Figure 14:
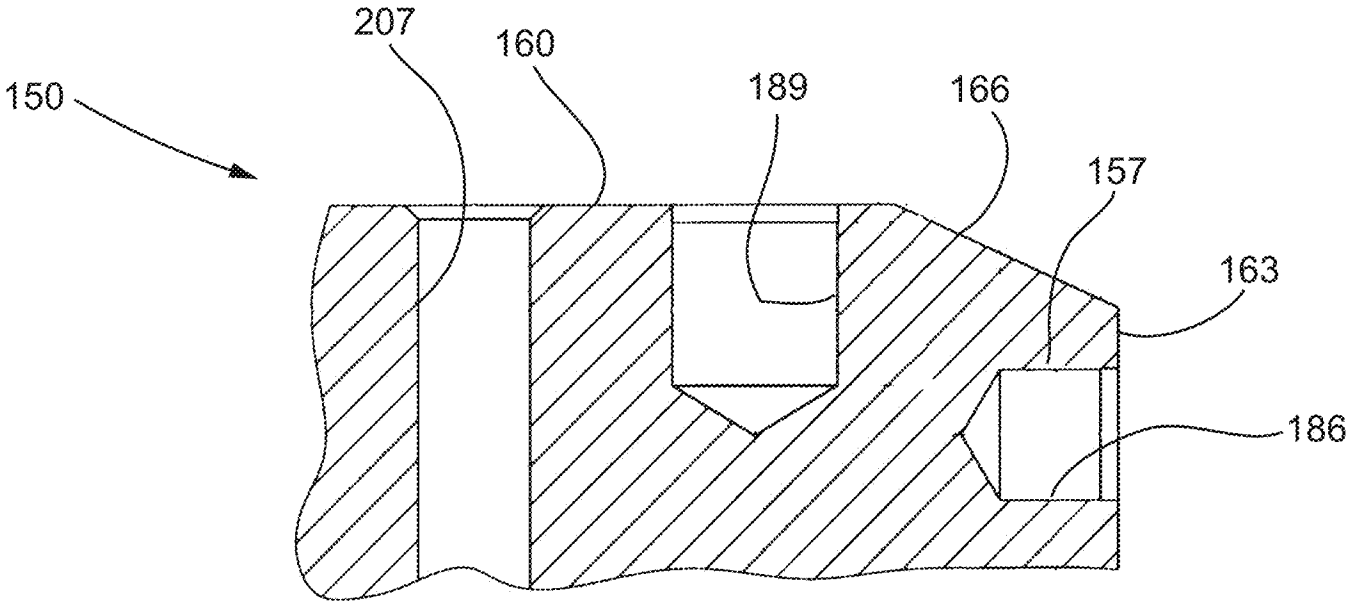
FIG. 14 is a cross-sectional detail view of the tool body of FIG. 11 taken along line 14-14 in FIG. 12.

Referring to FIGS. 8-10, an embodiment of a tool body blank 240 suitable for use in a ripper tool 52 constructed in accordance with principles of the present disclosure is shown. The tool body blank 240 can be constructed from a one-piece forging so that it includes the integral pivot boss 215. The tool body blank 240 can be made from any suitable material, such as a suitable steel or other metal. In embodiments, the tool body blank 240 can be made from any suitable material that has or can be treated to have a hardness of at least about 35 HRC.

In embodiments, the tool body blank 240 is made from a steel as described in U.S. Pat. No. 5,900,077, which is incorporated herein in its entirety. In embodiments, the tool body blank 240 can be constructed from a material commercially-marketed by Caterpillar Inc. as "Tough Steel."

In embodiments, the tool body blank 240 is made from a steel such that the tool body blank 240 has a composition, by weight percent, including from 0.20 to 0.45 carbon, from 0.4 to 1.5 manganese, from 0.5 to 2.0 silicon, from 0.01 to 2.0 chromium, from 0.15 to 1.2 molybdenum, from 0.01 to 0.40 vanadium, from 0.01 to 0.25 titanium, from 0.005 to 0.05 aluminum, from 0.0001 to 0.010 boron, less than 0.002 oxygen, from 0.005 to about 0.017 nitrogen, and the balance essentially iron. In embodiments, the tool body blank 240 can be free of any detrimental aluminum nitride and has, after quenching and tempering, a fully martensitic microstructure and a controlled distribution of spaced apart micrometer size titanium nitride cuboids and nanometer size background carbonitride precipitates. In embodiments, the tool body blank 240 can have, after quenching and tempering, a hardness of at least 45 HRC measured at the middle of a section having a thickness of no more than 25.4 mm (1 inch), and a plane strain fracture toughness of at least 150 MPa (136 ksi). In embodiments, the tool body blank 240 can have, after quenching and tempering, a hardness of at least 45 HRC measured at 12.7 mm (0.5 in) below the surface of a section having a thickness greater than 25.4 mm (1 in), and a plane strain fracture toughness of at least 150 MPa (136 ksi).

In embodiments, the tool body blank 240 can be made from a material with high hardenability, toughness, and temper resistance, but containing no more than 2.0% chromium by weight, and preferably between 0.01% and 0.50% chromium. In embodiments, the tool body blank 240 can be made from a material which does not require the presence of nickel to achieve the desired hardenability and toughness properties. In embodiments, the tool body blank 240 can be made from a material containing controlled amounts of oxygen to obtain optimum spacing of micrometer (μm) sized titanium nitride cuboids to obtain high fracture toughness and/or controlled amounts of titanium and vanadium to provide a fine scale distribution of fine scale (10-400 nanometer size) carbonitrides to improve fracture toughness.

In embodiments, the tool body blank 240 can be made from a material that is essentially free of nickel and copper. However it should be understood that, in embodiments, the tool body blank 240 can contain small quantities of nickel and copper which are not required and are considered incidental. In particular, up to 0.25% nickel and up to 0.35% copper may be present as residual elements in accepted commercial practice.

The tool body blank 240 can undergo a heat treating process to further harden the tool body blank 240. In embodiments, the tool body blank 240 is heat treated such that the hardness of the tool body 150 is at least about 35 HRC. In other embodiments, the tool body blank 240 is heat treated such that the hardness of the tool body 150 is at least about 45 HRC. In still other embodiments, the tool body blank 240 is heat treated such that the hardness of the tool body 150 is at least about 50 HRC. In yet other embodiments, the tool body blank 240 is heat treated such that the hardness of the tool body 150 is from about 45 HRC to about 60 HRC. The Rockwell hardness of the components of the ripper tool 52 can be measured following the procedures of ASTM E18-11, for example.

Referring to FIGS. 11-14, the tool body 150 of the ripper tool 52 constructed in accordance with principles of the present disclosure is shown. After the tool body blank 240 has been heat treated to increase its hardness, the tool body blank 240 can be machined to define the socket cavities 157 therein. A plurality of counterbores can be drilled and reamed to precise dimensions to define the first socket type 186 and the second socket type 189 of the socket cavities 157 which respectively correspond to the first cutter type 185 and the second cutter type 188 of the cutting element inserts 155 used in the ripper tool 52. The socket cavities 157 can be arrayed in a predetermined manner to distribute the cutting element inserts 155 in a desired pattern over the tool body 150. In embodiments, adjacent socket cavities 157 are arranged such that they are disposed a separation distance "D" from each other (see FIG. 11). In embodiments, the separation distance "D" can be about equal to the size of the inner diameter of one of the socket cavities 157 or more.

The first socket type 186 of the socket cavities 157 can be machined to correspond to the shape of the shank of the first cutter type 185 of the cutting element inserts 155. The second socket type 189 of the socket cavities 157 can be machined to correspond to the shank of the second cutter type 188 of the cutting element inserts 155. Each socket cavity 157 can have an internal diameter that is slightly smaller than the exterior diameter of the shank of the mating cutting element insert 155.

In some embodiments, the tool body blank 240 can be ground at a pair of side edges 245, 246 of the penetrating end surface 160 (see FIG. 8) to define the pair of chamfer surfaces 165, 166 disposed between the penetrating end surface 160 and the ripping side surfaces 162, 163, respectively. In some embodiments, the through bore 207 can be machined in the tool body blank 240 (see FIGS. 13 and 14). The through bore 207 can be configured to receive therein a suitable sensor device adapted to detect the amount of wear the ripper tool has been subjected to in use.

Figure 16:
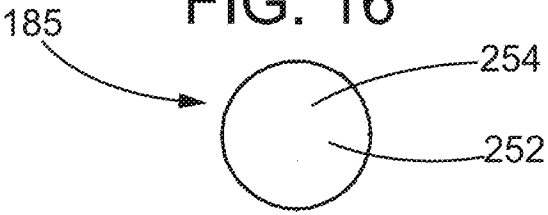
FIG. 16 is a top plan view of the carbide cutting element insert of FIG. 15.
Figure 15:
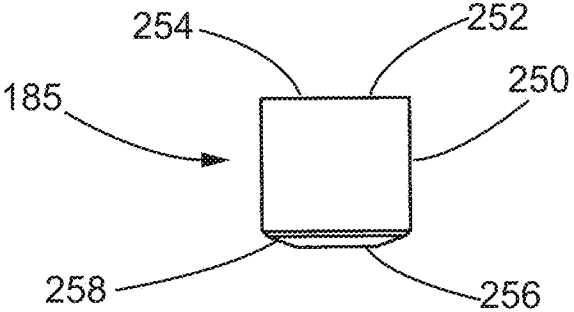
FIG. 15 is an elevational view of a first embodiment of a carbide cutting element insert suitable for use in a ripper tool constructed in accordance with principles of the present disclosure.

Referring to FIGS. 15 and 16, the first cutter type 185 of the cutting element inserts 155 is shown. The first cutter type 185 of the cutting element inserts 155 includes a shank in the form of a cylindrical barrel 250 and a coterminous cutting portion 252 disposed at a distal end 254. The cylindrical barrel 250 of the first cutter type 185 includes a proximal end 256 that includes a chamfer surface 258 to facilitate the insertion of the first cutter type 185 of the cutting element inserts 155 into one of the socket cavities 157 of the first socket type 186. The remainder of the cylindrical barrel 250 is substantially uniform.

The cutting portion 252 can have any of a variety of shapes depending on the desired cutting structure of the cutting element insert 155. In the illustrated embodiment, the cutting portion 252 of the first cutter type 185 is a flat-shaped cylinder. In other embodiments, the cutting portion 252 of the cutting element insert 155 can have different shapes such as conical, frusto-conical, chisel-shaped, tear drop-shaped, or ballistic-shaped, for example.

Figure 18:
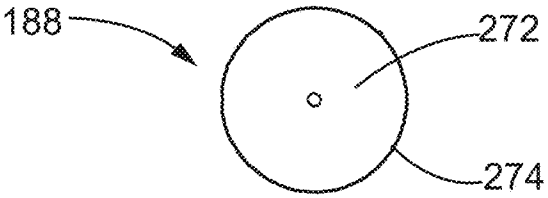
FIG. 18 is a top plan view of the carbide cutting element insert of FIG. 17.
Figure 17:
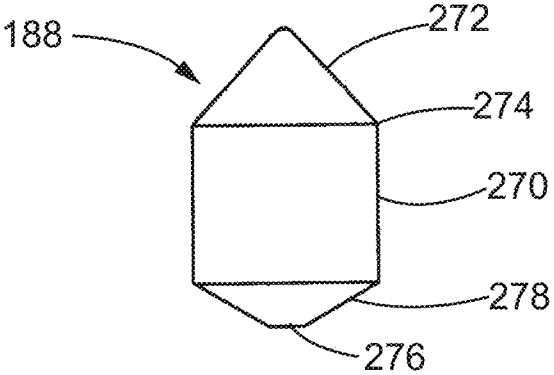
FIG. 17 is an elevational view of a second embodiment of a carbide cutting element insert suitable for use in a ripper tool constructed in accordance with principles of the present disclosure.

Referring to FIGS. 17 and 18, the second cutter type 188 of the cutting element inserts 155 is shown. The second cutter type 188 of the cutting element inserts 155 includes a shank in the form of a cylindrical barrel 270 and a coterminous distal cutting portion 272 disposed at a distal end 274. The cylindrical barrel 270 of the second cutter type 188 includes a proximal end 276 that includes a chamfer surface 278 to facilitate the insertion of the second cutter type 188 of the cutting element inserts 155 into one of the socket cavities 157 of the second socket type 189. The remainder of the cylindrical barrel 270 is substantially uniform.

The cutting portion 272 can have any of a variety of shapes depending on the desired cutting structure of the cutting element insert 155. In the illustrated embodiment, the cutting portion 272 of the second cutter type 188 is conical. In other embodiments, the cutting portion 272 of the cutting element insert 155 can have different shapes such as frusto-conical, flat-shaped, chisel-shaped, tear drop-shaped, or ballistic-shaped, for example.

The first cutter type 185 and the second cutter type 188 of the cutting element inserts 155 can comprise any suitable material, such as, tungsten carbide, for example. In embodiments, the cutting element inserts 155 can be made from a suitably hard material which is harder than the hardness of the tool body 150. In embodiments, the cutting element inserts 155 have a hardness of at least about 60 HRC. In embodiments, the average hardness of the cutting element inserts 155 is from about 10 HRC to about 25 HRC harder than the tool body 150.

Figure 19:
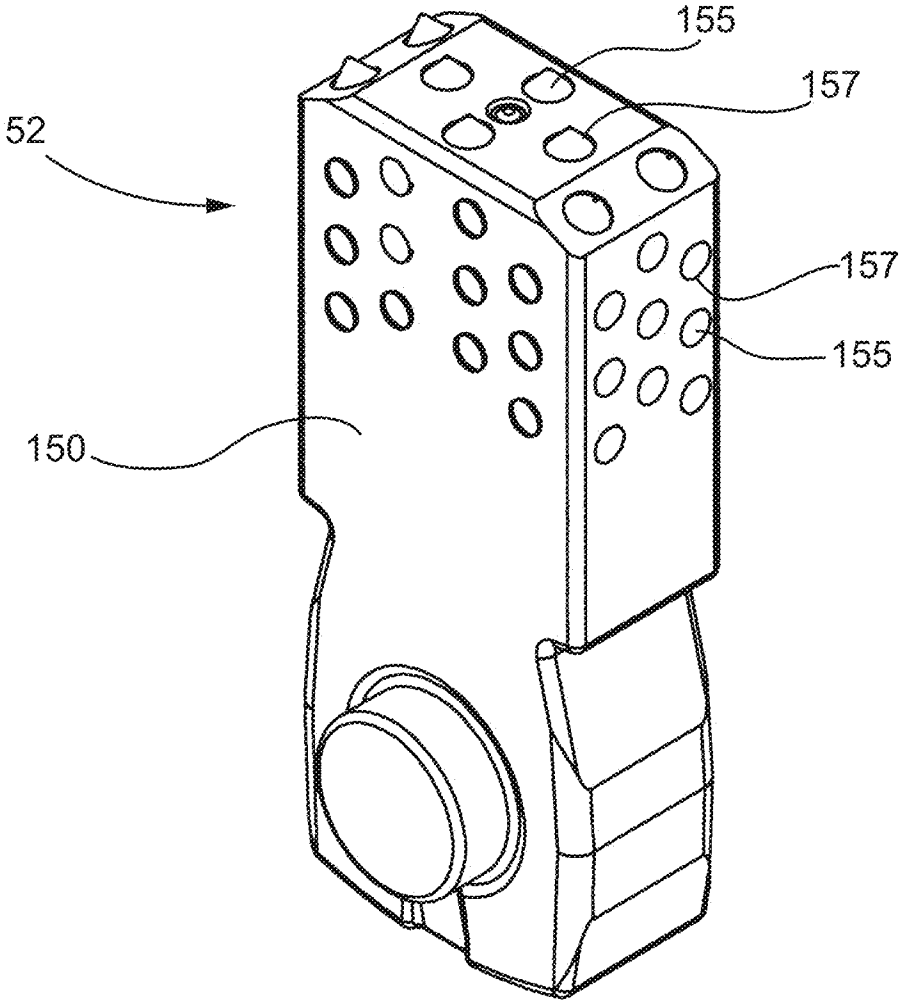
FIG. 19 is a perspective view of an embodiment of a ripper tool constructed in accordance with principles of the present disclosure.
Figure 20:
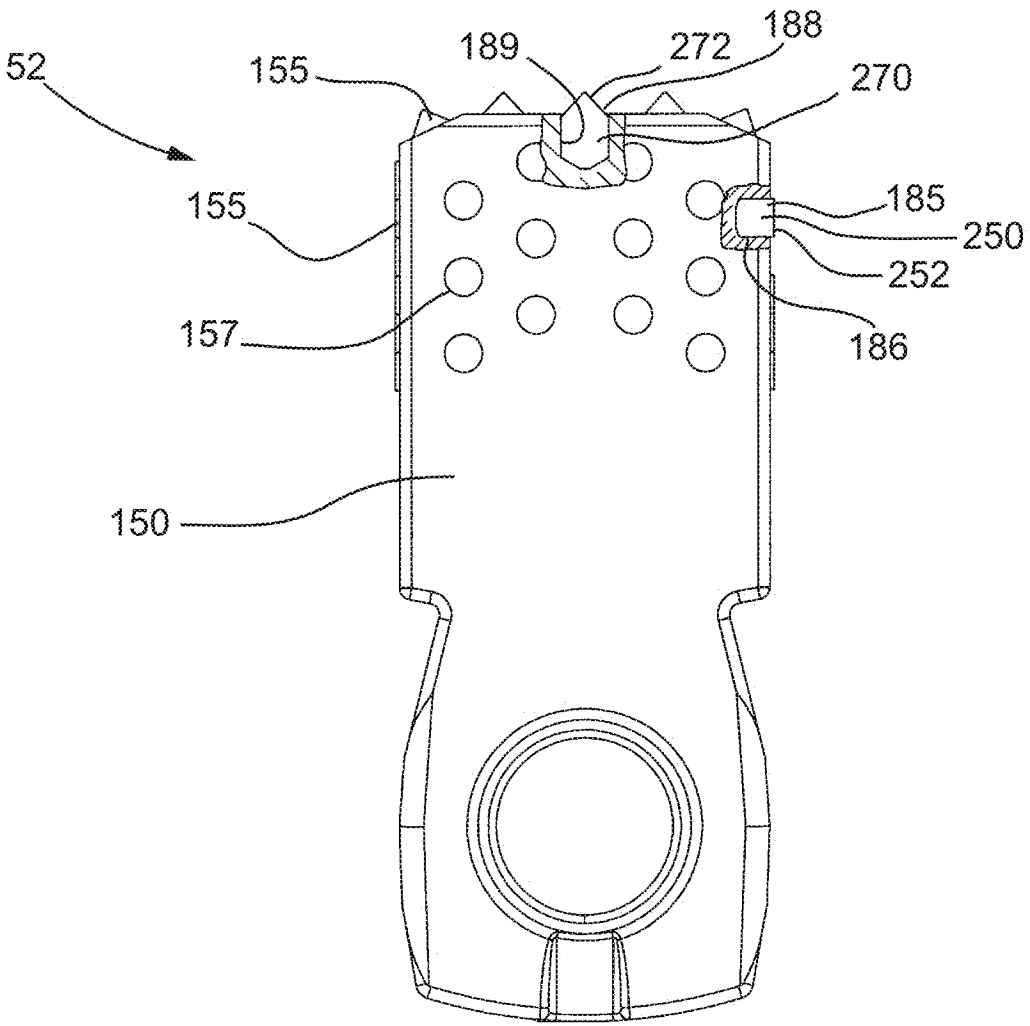
FIG. 20 is a washout face elevational view, partially cut away, of the ripper tool of FIG. 19.
Figure 21:
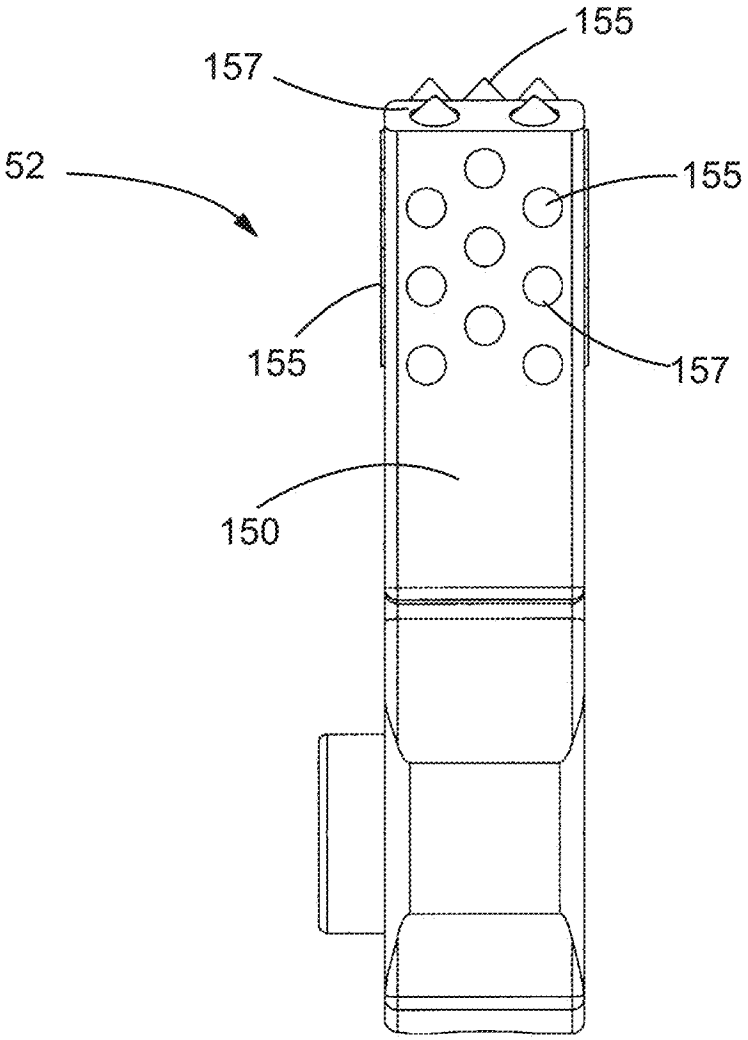
FIG. 21 is a ripper side elevational view of the ripper tool of FIG. 19.

Referring to FIGS. 19-21, the ripper tool 52 is shown with the cutting element inserts 155 mounted in the socket cavities 157 of the tool body 150 with a press fit.

Referring to FIG. 20, the cylindrical barrel 250 of the first cutter type 185 of the cutting element inserts 155 can be inserted into one of a plurality of the socket cavities 157 of the first socket type 186 formed within the tool body 150. The cylindrical barrel 250 of the first cutter type 185 of the cutting element inserts 155 and the first socket type 186 of the socket cavities 157 can be configured to substantially conform to each other. The first socket type 186 has a diameter that is slightly smaller than the outer diameter of the cylindrical barrel 250 of the first cutter type 185 to provide an interference fit therebetween. The cylindrical barrel 250 of the first cutter type 185 and the mating socket cavity 157 of the first socket type 186 are configured such that when the cylindrical barrel 250 of the first cutter type 185 of the cutting element inserts 155 is inserted therein, the distal cutting portion 252 protrudes from the mating socket cavity 157 of the first socket type 186.

The cylindrical barrel 270 of the second cutter type 188 of the cutting element inserts 155 can be inserted into one of a plurality of the socket cavities 157 of the second socket type 189 formed within the tool body 150. The second socket type 189 of the socket cavities 157 is configured to substantially conform to the shape of the cylindrical barrel 270 of the second cutter type 188 of the cutting element inserts 155 received therein. The second socket type 189 has a diameter that is slightly smaller than the outer diameter of the cylindrical barrel 270 of the second cutter type 188 to provide an interference fit therebetween. The cylindrical barrel 270 of the second cutter type 188 and the mating socket cavity 157 of the second socket type 189 are configured such that the cutting portion 272 of the second cutter type 188 of the cutting element inserts 155 protrudes the second socket type 189 of the socket cavities 157 when seated therein.

Figure 22:
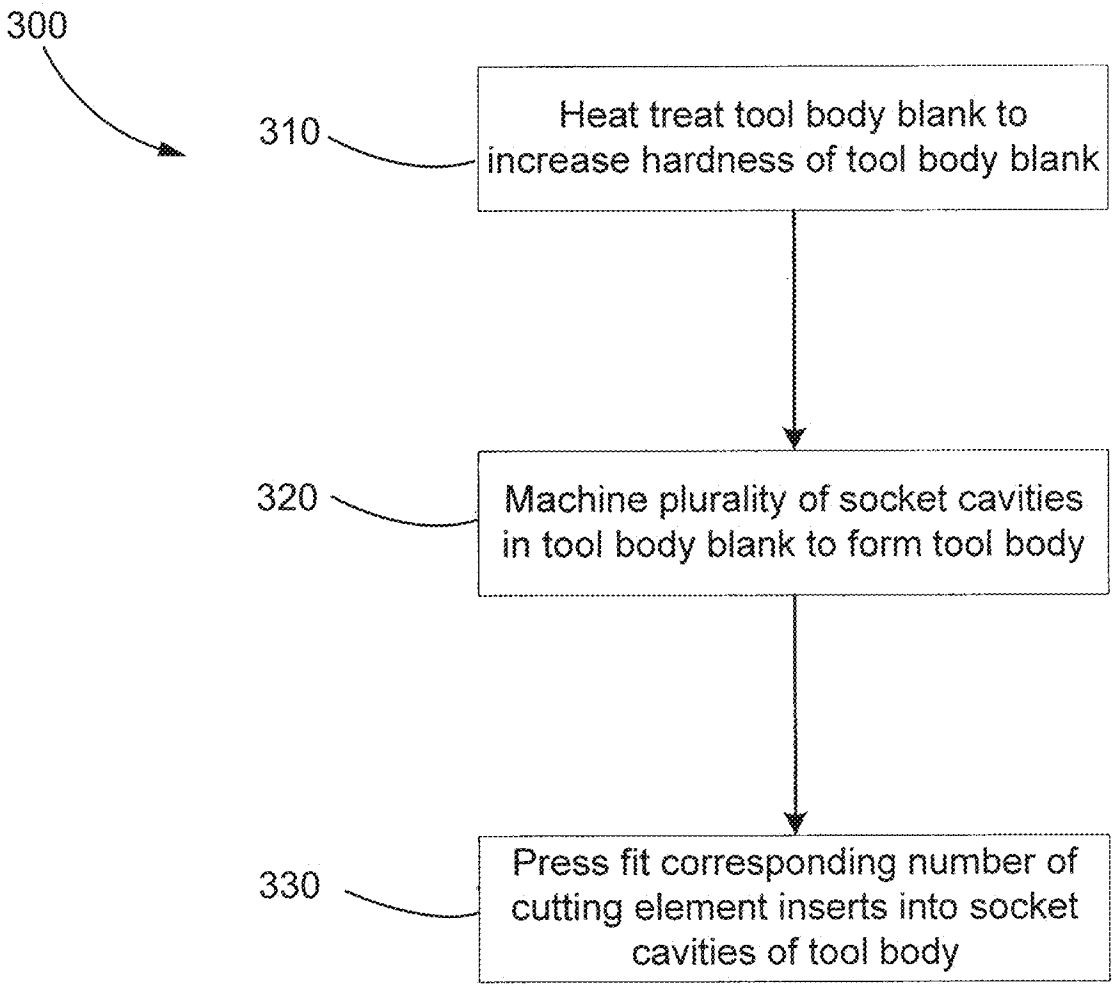
FIG. 22 is a flowchart illustrating steps of an embodiment of a method for making a ripper tool according to principles of the present disclosure.

Referring to FIG. 22, steps of an embodiment of a method 300 for manufacturing a cutting head tool for a tunnel boring machine in accordance with principles of the present disclosure are shown. A tool body blank 240 is heat treated to increase the hardness of the tool body blank 240 (step 310). A plurality of socket cavities 157 are machined in the tool body blank 240 in a predetermined hole pattern to form a tool body 150 (step 320). A corresponding number of cutting element inserts 155 are press fitted into the socket cavities 157 in the tool body 150 (step 330).

The tool body blank 240 can be made by any suitable technique, such as forging, for example. The tool body blank 240 can be made such that it includes an integral pivot boss 215 extending therefrom.

The heat treating step (step 310) can include techniques known to those skilled in the art. For example, the tool body blank 240 can be heated. In embodiments, the tool body blank 240 is made from steel and is through heated to the austenitizing temperature of the steel to produce a homogeneous solution throughout the section without harmful decarburization, grain growth, or excessive distortion. The heated tool body blank 240 can be quenched. In embodiments, the heated tool body blank 240 is fully quenched in water to produce the greatest possible depth of hardness. The quenched tool body blank 240 can be tempered. In embodiments, the tool body blank 240 is tempered by reheating for a sufficient length of time to permit temperature equalization of all sections. The tempered tool body blank 240 can be allowed to cool to ambient temperature.

The tool body blank 240 can be heat treated to increase its hardness such that the use of "hard facing" (chromium carbide plates welded to the washout faces and/or ripper sides, e.g.) can be omitted in some embodiments. The tool body blank 240 can be heat treated such that the hardness of the tool body blank 240 is at least about 45 HRC. In still other embodiments, the tool body blank 240 is heat treated such that the hardness of the tool body blank 240 is at least about 50 HRC. In yet other embodiments, the tool body blank 240 is heat treated such that the hardness of the tool body blank 240 is from about 45 HRC to about 60 HRC.

In embodiments, the tool body blank 240 is heat treated such that the hardness of the tool body 150 is within about 25 HRC of the average hardness of the cutting element inserts. In other embodiments, the tool body blank 240 is heat treated such that the hardness of the tool body 150 is within from about 10 HRC to about 25 HRC of the average hardness of the cutting element inserts 155.

The socket cavities 157 can be machined after the tool body blank 240 is heat treated to form the tool body 150. Machining the tool body blank 240 after it has been heat treated can avoid distortion and quench cracking problems that may occur when the socket cavities 157 are machined before heat treating.

The cutting element inserts 155 can be made by any suitable technique, such as sintering, for example. Each cutting element insert 155 can be ground so that its outer dimension is within a predetermined tolerance to help ensure a consistent press fit with its mating socket cavity 157 in the tool body 150. The outer dimension of each cutting element insert 155 and the inner dimension of the corresponding socket cavity 157 can be machined such that the press fit between the mating components is sufficient to hold the cutting element inserts 155 in place without the need for any brazing.

INDUSTRIAL APPLICABILITY

The industrial applicability of embodiments of a ripper tool 52 constructed according to principles of the present disclosure will be readily appreciated from the foregoing discussion. The described principles are applicable to ripper tools for use in multiple embodiments of a machine and have applicability in many tunnel boring machines and other machines which use ripper tools where they can be used to crush and remove rock in the construction of wells, tunnels, or other underground structures.

A ripper tool 52 constructed in accordance with principles of the present disclosure can use a press fit to secure the cutting element inserts 155 to the tool body 150 that is sufficient by itself to hold the cutting element inserts 155 in place without the need for any brazing. A ripper tool 52 constructed in accordance with principles of the present disclosure can provide a tool body 150 that is many time harder, and therefore more abrasive resistant, than the material that is used in a conventional ripper tool constructed using brazing techniques to secure the cutting element inserts. For example, in embodiments, the base material of the heat treated tool body 150 can be at least about 1500 MPa stronger than the base material in a brazed ripper. Also, the base material of the heat treated tool body 150 can be about three times tougher than the base material in a brazed ripper.

A ripper tool 52 constructed in accordance with principles of the present disclosure can include a tool body 150 with an integral pivot boss 215 to allow the ripper tool 52 to be pivotably mounted to a ripper housing 140 for example. The use of an integral pivot boss 215 can eliminate the need for a separate machining operation in the tool body blank 240 to accept a pin and the need to weld the pin to the tool body 150, which can also degrade the performance of the tool body 150.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A ripper tool comprising:

a tool body and a pivot boss, the tool body having a plurality of socket cavities defined therein, and the pivot boss projecting from and being integral with the tool body;

a plurality of cutting element inserts mounted to the tool body, the plurality of cutting element inserts being respectively press fit in the plurality of socket cavities.

2. The ripper tool of claim 1, further comprising:

a housing, the housing including a pivot bearing adapted to support the integral pivot boss of the tool body such that the tool body is rotatable about the integral pivot boss over a range of travel.

3. The ripper tool of claim 2, wherein the housing includes a pair of side plates, and the tool body includes a pair of shoulders disposed on opposing sides thereof, each of the pair of shoulders of the tool body adapted to engage the pair of side plates, respectively, to limit the range of travel over which the tool body is rotatable.

4. The ripper tool of claim 1, wherein the tool body includes a penetrating end surface disposed at a distal end of the tool body, a pair of ripping side surfaces in spaced relationship to each other and disposed at a respective side of the tool body, and a pair of washout face surfaces in spaced relationship to each other and respectively disposed at a front face and a rear face of the tool body, the pair of washout face surfaces extending between the pair of ripping side surfaces.

5. The ripper tool of claim 4, wherein at least one of the plurality of cutting element inserts comprises a first cutter type and at least one of the plurality of cutting element inserts comprises a second cutter type, at least one of the plurality of socket cavities comprises a first socket type and at least one of the plurality of socket cavities comprises a second socket type, each cutting element insert of the first cutter type being disposed in a respective socket of the first socket type, each cutting element insert of the second cutter type being disposed in a respective socket of the second socket type, at least one socket cavity of the first socket type being defined in at least one of the pair of ripping side surfaces, and at least one socket cavity of the second socket type being defined in the penetrating end surface.

6. The ripper tool of claim 5, wherein cutting element inserts of the first cutter type are disposed in socket cavities of the first socket type defined in at least one of the pair of washout face surfaces.

7. The ripper tool of claim 1, wherein the tool body comprises a heat-treated material having a hardness of at least about 45 HRC.

8. The ripper tool of claim 1, wherein the tool body comprises a heat-treated material having a hardness of at least about 50 HRC.

9. The ripper tool of claim 1, wherein the tool body comprises a heat-treated material having a hardness from about 45 HRC to about 60 HRC.

10. The ripper tool of claim 1, wherein the tool body has a tool body hardness and each of the plurality of cutting element inserts has an insert hardness such that an average insert hardness of the plurality of cutting element inserts is from about 10 HRC to about 25 HRC greater than the tool body hardness.

11. The ripper tool of claim 1, wherein the plurality of cutting element inserts comprise tungsten carbide.

12. A machine comprising:

a cylindrical shell;

a cutter head rotatably mounted at a distal end of the cylindrical shell, the cutter head including a ripper tool rotatably mounted thereto, the ripper tool including:

a tool body and a pivot boss, the tool body having a plurality of socket cavities defined therein, and the pivot boss projecting from and being integral with the tool body, the ripper tool being rotatably movable about the integral pivot boss over a predetermined range of travel with respect to the cutter head, and a plurality of cutting element inserts mounted to the tool body, the plurality of cutting element inserts being respectively press fit in the plurality of socket cavities.

13. The machine of claim 12, wherein the tool body of the ripper tool comprises a heated-treated material having a hardness of at least about 45 HRC.

14. A method for making a cutting head tool, the method comprising:

heat treating a tool body blank to increase a hardness of the tool body blank, the tool body blank including an integral pivot boss;

machining, after the tool body blank is heat treated, a plurality of socket cavities in the heat treated tool body blank in a predetermined hole pattern to form a tool body;

press fitting a plurality of cutting element inserts, respectively, into the plurality of socket cavities in the tool body.

15. The method according to claim 14, wherein heat treating includes heating the tool body blank, quenching the tool body blank after heating, and tempering the tool body blank after quenching.

16. The method according to claim 14, wherein the tool body blank is heat treated such that the tool body has a hardness of at least about 45 HRC.

17. The method according to claim 14, wherein the plurality of cutting element inserts and the plurality of socket cavities are respectively press fit such that the plurality of cutting element inserts are held in place without the need for any brazing.

18. The method according to claim 14, wherein the tool body blank is heat treated such that the tool body has a hardness of at least about 50 HRC.

19. The method according to claim 14, wherein the tool body blank is heat treated such that the tool body has a hardness from about 45 HRC to about 60 HRC.

20. The method according to claim 14, wherein the tool body blank is heat treated such that the tool body has a tool body hardness and each of the plurality of cutting element inserts has an insert hardness such that an average insert hardness of the plurality of cutting element inserts is from about 10 HRC to about 25 HRC greater than the tool body hardness.

* * * * *